United States Patent [19]

Hieronymus

[11] 4,378,479

[45] Mar. 29, 1983

[54] PERMANENT CURRENT SWITCH FOR SHORT CIRCUITING A SUPERCONDUCTING MAGNET

[75] Inventor: Hans Hieronymus, Erlangen, Fed. Rep. of Germany

[73] Assignee: Siemens Aktiengesellschaft, Munich, Fed. Rep. of Germany

[21] Appl. No.: 61,013

[22] Filed: Jul. 26, 1979

Related U.S. Application Data

[63] Continuation of Ser. No. 872,833, Jan. 27, 1978, abandoned.

[30] Foreign Application Priority Data

Feb. 22, 1977 [DE] Fed. Rep. of Germany ..... 2707589

[51] Int. Cl.[3] ..... H01H 1/02

[52] U.S. Cl. ..... 200/263; 200/289

[58] Field of Search ..... 200/263, 262, 275, 242, 200/248, 156, 268, 149 R, 149 A, 150 C, 289

[56] References Cited

U.S. PATENT DOCUMENTS

| | | | |
|---|---|---|---|
| 2,400,003 | 5/1946 | Hensel et al. | 200/262 |
| 3,170,054 | 2/1965 | Lawrence et al. | 200/266 |
| 3,548,135 | 12/1970 | Wood | 200/263 |
| 3,597,562 | 8/1971 | Turnbull | 200/267 |
| 3,852,544 | 12/1974 | Grunert et al. | 200/289 |
| 4,021,633 | 5/1977 | Kuwabara et al. | 200/262 |
| 4,024,363 | 5/1977 | Marsing et al. | 200/289 |

*Primary Examiner*—Willis Little

*Attorney, Agent, or Firm*—Kenyon & Kenyon

[57] ABSTRACT

A permanent current switch for short circuiting a superconducting magnet with at least two contacts, in which the contact surface of one of the contacts has the shape of a calotte and the contact force (F) is at least 500 N, permitting the use of contacts made exclusively of normally conducting material and resulting in a simple, operationally reliable mechanism.

10 Claims, 4 Drawing Figures

PERMANENT CURRENT SWITCH FOR SHORT CIRCUITING A SUPERCONDUCTING MAGNET

This is a continuation, of application Ser. No. 872,833 filed Jan. 27, 1978, now abandoned.

BACKGROUND OF THE INVENTION

This invention relates to superconducting magnets in general and more particularly to a permanent current switch for short circuiting a superconducting magnet.

Once a magnetic field of a superconducting coil, particularly a high field intensity magnet coil, is generated, practically no further energy need be fed to the coil from the outside for maintaining the field, and only the energy required for the refrigeration equipment needed to maintain the superconducting state of the coil still needs to be supplied. For storing the electric energy fed into the coil, the coil can therefore be short circuited at its ends by means of a permanent current switch of minimum resistance. The current then flows almost unattenuated in the short circuited circuit so formed, and the current supply required for the excitation of the magnet coil can thereupon be interrupted.

A corresponding permanent current switch is known, for instance, from U.S. Pat. No. 4,021,633. The permanent current switch contains two contacts, of which one has, for instance, a plane contact surface, while the surface of the second contact is curved. The two contacts are made of two different materials. One part of each contact consists of a high purity metal which is normally conducting at the lowest temperatures, such as copper or aluminum, while the other part of each contact contains superconductor material. The normally conducting material serves primarily as the stabilizing material for the superconductor material. A mechanical actuating device for opening and closing the switch is designed so that the superconducting parts of the two contacts, as well as their normal conducting parts, each can be joined together directly. Therefore, special guide devices must be provided which ensure accurate contact of the superconducting surfaces. In the known permanent current switch there is further provided a vacuum chamber, in which the contacts are arranged, in order to thus preclude contamination of the surfaces. The design of the known switch is therefore relatively elaborate, and, in addition, only indirect cooling of the superconducting contact surfaces is possible.

Since the superconducting contacts of the known permanent current switch are to allow maximum current densities, but since the current carrying capacity depends on the external magnetic fields, as is well known, this switch cannot be arranged in the immediate vicinity of a superconducting magnet with high field intensity.

SUMMARY OF THE INVENTION

It is therefore an object of the present invention to provide a permanent current switch of high current carrying capacity for superconducting magnets, in which the difficulties of the known permanent current switch are not present, or only to a negligible degree. In addition, the design of the permanent current switch and in particular, that of its contacts is to be simplified.

According to the present invention, this problem is solved for a permanent current switch of the type mentioned at the outset by the provision that the curved contact surface is made in the shape of a calotte and that the contact force is at least 500 N.

The advantages of this design of a permanent current switch are, in particular, that, with full contact force, good contact of the two contact surfaces at their common contact zone is brought about on the one hand, on the other hand, simultaneously cleaning of the contact zone due to the mutual friction between the two contact surfaces occurs. Thus, a particularly low contact resistance can be achieved. Therefore, the use of superconductive material for the contacts of the switch according to the present invention can be dispensed with, i.e., the contacts will advantageously consist exclusively of normally conducting material. For, it has been found that the losses caused by such a switch are only negligibly higher than those of a switch with superconducting contacts.

According to a further embodiment of the permanent current switch according to the present invention, the contacts can advantageously consist of fine silver. Fine silver is required since impurities in the silver due to foreign atoms lead to a particularly large increase of the resistance at low temperatures. Fine silver with a silver content of about 99.97% has a particularly low resistivity at low temperatures. The latter can advantageously be reduced still further if so-called "doubly refined" or "chemically pure" silver with a silver content of at least 99.995%, or high-purity fine silver with a silver content of 99.999% is used.

In addition, soft-annealed silver can advantageously be used for the contacts of the permanent current switch according to the present invention. This material, which is generally heat treated at temperatures between 400° and 700° C., with a Brinell hardness of, for instance, between 150 and 360 N/mm$^2$ ensures a particularly thorough junction of the two joined contacts at the common contact zone developed between their contact surfaces for the predetermined contact force. In conjunction with the particularly low residual resistance at low temperatures, a correspondingly low contact resistance can be obtained in this manner.

It is further particularly advantageous to make the hardness of the materials of the two contact surfaces different. One can thereby prevent the so-called cold welding of the two contact surfaces at their common, relatively large contact zone. One of the contact surfaces can therefore be covered to advantage with an indium layer, while the other contact surface consists of fine silver. For, indium is a softer material than, for instance, fine silver, as is well known.

The permanent current switch according to the present invention can also comprise two plane contacts which are arranged at an inclination to each other and between which a further contact with two calotte shaped contact surfaces can be inserted. This embodiment of the permanent current switch has the particular advantage that, during switching processes, movements of the generally superconducting conductors, which are connected to the switch, are avoided. The actuating device of this switch is furthermore particularly simple, and the movable intermediate piece is readily exchangeable.

DETAILED DESCRIPTION OF THE INVENTION

Figure 1:
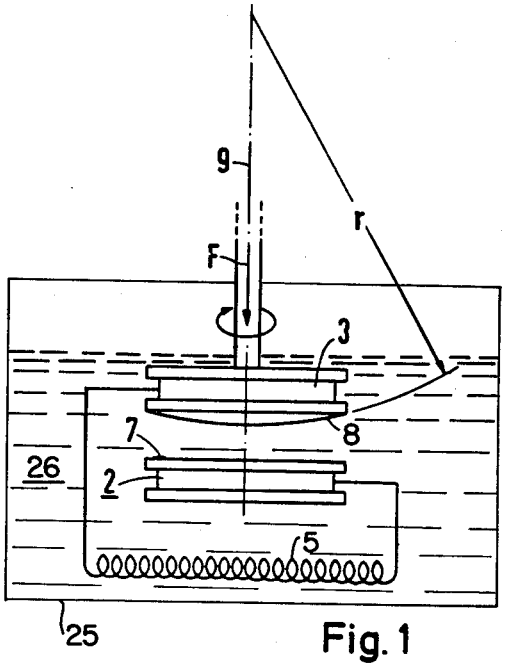
FIG. 1 is a schematic-elevation view of a permanent current switch according to the present invention.

The permanent current switch, which is indicated in cross section in FIG. 1 but is detailed only in part, contains a stationary contact 2 and a contact 3 which is movable by means of an actuating device not detailed in the figure. The two contacts can be pressed together by means of the actuating device with a contact force F represented by an arrow and are connected to the ends of the conductors of a superconducting magnet coil 5 in an electrically conducting manner, for instance, by soldering. The coil may be, for instance, a magnet for the suspension guidance of a vehicle over an electrically conducting rail by the electrodynamic repulsion principle. The contact surface 7 of the contact 2 is flat, while the contact surface 8 of the contact 3 is curved and has the shape of a calotte. Its relatively large radius of curvature is designated as r.

The contacts 2 and 3 can advantageously consist of fine silver of high purity, i.e., with a silver content above 99.97%. This silver material is preferably soft annealed in addition. The hardness of the contact surfaces is advantageously chosen to be different. If desired, at least one of the contact surfaces 7 or 8 may be covered with an indium layer which is, for instance, 0.5 mm thick, whereby a full contact area is obtained.

When the permanent current switch is closed, not only is the contact 2 pushed against contact 3 with a force of at least 500 N and preferably, at least 1000 N, but one of the two contacts, e.g., the contact 3 is slightly rotated by a few degrees about an axis 9 perpendicular to the plane contact surface 7 of the contact 2. In this manner, a contact with a particularly low resistance is obtained at the common contact zone developed between the two contact surfaces 7 and 8, since, on the one hand, the two contact surfaces are deformed slightly and are in intimate contact with each other at the contact zone but, on the other hand, the rotary motion causes a cleaning effect in the contact zone between the two contact surfaces 7 and 8.

According to the embodiment of the permanent current switch of FIG. 1, the two contacts 2 and 3 consist of fine silver with different hardnesses. The contact surface 8 of the contact 3, shaped as a calotte, has a radius of curvature of about 80 mm. If the two contacts 2 and 3 are pressed together with a contact force of about 2000 N, the contact 3 is rotated approximately 5° about the axis 9. A switch resistance of less than $8\times10^{-8}$ ohm is then obtained.

Figure 2:
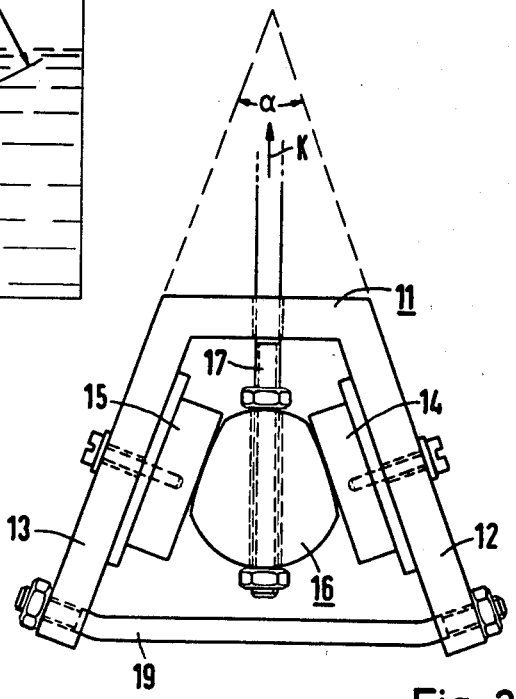
FIG. 2 is a plan view of a further embodiment of such a permanent current switch with a movable intermediate contact piece.

The permanent current switch detailed in partial cross section in FIG. 2 contains a V-frame 11, the free legs 12 and 13 of which are spread apart by a predetermined angle $\alpha$. On the insides of these two legs 12 and 13, plane contacts 14 and 15, respectively, are arranged, and are connected to the ends of the conductors of a superconducting magnet, not shown in the figure. Contacts 14 and 15 correspond to the stationary contact 2 of FIG. 1. A short circuit between the two contacts 14 and 15 is brought about by a movably arranged intermediate contact piece 16, which is pulled by an actuating rod 17 of an actuating device, not detailed in the figure, between the mutually inclined contacts 14 and 15 with a predetermined pulling force K indicated by an arrow.

When the intermediate contact piece 16 is pulled into the gap which is formed between the two contacts 14 and 15 and is tapered in the pulling direction, the contacts 14, 15 and 16 get slightly deformed at their common contact zones. In this manner, a tight connection of these contact pieces and, in particular, cleaning of the contact zones due to friction is brought about. The legs 12 and 13 can spread somewhat. The spreading of the two legs can advantageously be fixed to a predetermined extent by a limiting device arranged between their two free ends, for instance, by a rod 19.

Figure 3:
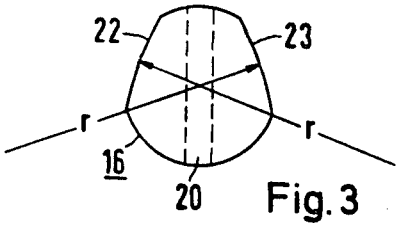
FIGS. 3 and 4 illustrate a cross section and side view, respectively, of the intermediate contact piece of FIG. 2.
Figure 4:
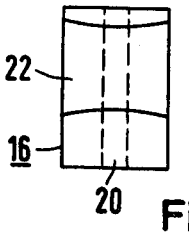

From FIGS. 3 and 4, further details of the movable intermediate contact piece 16 of the permanent current switch according to FIG. 2 can be seen. In these figures a central hole 20 in the intermediate contact piece 16, through which the actuating rod 17 is pushed is indicated by dashed lines. The two contact surfaces 22 and 23 of the intermediate contact piece 16, against which the corresponding contact surfaces of the contacts 14 and 15 rest in the closed condition of this switch, have the shape of calottes with a relatively large radius of curvature r.

In order to prevent cold welding of the contacts at their common contact zones, it is advantageous that the hardness of the contact surfaces 22 and 23 be different from that of the surfaces of the contacts 14 and 15 associated with them. This can be achieved, for instance, by providing fine silver of different hardness for the contacts or by covering one of the respective contact surfaces, for instance, the surfaces 22 and 23, with an indium layer.

According to an embodiment of a permanent current switch as per FIGS. 2 to 4, the radius of curvature r of the contact surfaces 22 and 23 of the intermediate contact piece 16 is about 80 mm. The two legs 12 and 13 and, thus the two contacts 14 and 15 are inclined relative to each other by an angle $\alpha$ of about 40° C. This prevents so-called self-locking of the device because $\tan(\alpha/2)>\mu$, where $\mu$ is the friction coefficient of the surface material of the contact surfaces. Fine silver is provided as material for the contacts 14 to 16. If the intermediate contact piece 16 is pulled between the two contacts 14 and 15 with a force of $K=2000$ N, then a switch resistance of less than $2\times10^{-7}$ ohm is obtained.

Due to the relatively low resistance, the permanent current switches according to the present invention are suitable particularly for maintaining the magnetic field in a superconductor magnet, even over extended periods of time, independently of an external current supply. The switches can be arranged in the immediate vicinity of the magnet coils and can carry relatively large currents of, for instance, more than 1000 A without difficulty. The coolant 26 provided for cooling the conductors connected to the contacts can also be provided directly for cooling the contacts. Thus, the switch can be located, for instance, in the cryostat 25 of the associated magnet coil containing the coolant 26.

What is claimed is:

1. In a permanent current switch for short circuiting a superconducting magnet, cooled by a cryogenic medium, said switch including at least two contacts, at least one of which is curved and which contact consists of high purity, electrically highly conductive material and are cooled by the cryogenic medium, and mechanical actuating means for bringing said contacts together with a contact force of at least 500 N, the improvement comprising:

(a) the contacts being disposed directly in said cryogenic medium within a cryostat containing said cryogenic medium for cooling said superconducting magnet;

(b) both of the contacts consisting exclusively of fine silver;

(c) the curved contact surface being shaped as a calotte; and (d) the hardness of the materials of the contact surfaces being different.

2. The improvement according to claim 1, wherein said contact force is at least 1000 N.

3. The improvement according to claim 1, wherein at least one contact is made of chemically pure fine silver.

4. The improvement according to claim 1, wherein at least one contact is made of soft-annealed silver.

5. The improvement according to claim 1, wherein one of the contact surfaces is provided with an indium layer.

6. The improvement according to claim 1, wherein said switch contacts are disposed in a liquid cryogenic medium.

7. In a permanent current switch for short circuiting a superconducting magnet, cooled by a cryogenic medium, said switch including at least two contacts, at least one of which is curved and which contact consists of high purity, electrically highly conductive material and are cooled by the cryogenic medium, and mechanical actuating means for bringing said contacts together with a force of at least 500 N, the improvement comprising:

(a) the contacts being disposed directly in said cryogenic medium within a cryostat containing said cryogenic medium for cooling said superconducting magnet;

(b) at least one of the contacts consisting exclusively of fine silver;

(c) the curved contact surface being shaped as a calotte;

(d) the hardness of the materials of the contact surfaces being different; and (e) said mechanical actuating means including a rotating device for bringing about a slight rotation of the one contact surface on the other contact surface about an axis of rotation in the direction of the contact force.

8. In a permanent current switch for short circuiting a superconducting magnet, cooled by a cryogenic medium, said switch including at least two contacts, at least one of which is curved and which contacts consist of high purity, electrically highly conductive material and are cooled by the cryogenic medium, and mechanical actuating means for bringing said contacts together with a contact force of at least 500 N, the improvement comprising:

(a) the contacts being disposed directly in said cryogenic medium within a cryostat containing said cryogenic medium for cooling said superconducting magnet;

(b) said switch comprising two stationary plane contacts made of fine silver, inclined relative to each other and a further movable single contact piece with two calotte-shaped contact surfaces made of fine silver, disposed between said two plane contacts and connected to the mechanical actuating means; and (c) the hardness of the material of the contact surfaces of the plane contacts and the further single contact piece being different.

9. The improvement according to claim 8, wherein said two plane contacts are fastened rigidly to the insides of the legs of a V-shaped frame element.

10. The improvement according to claim 9, and further including means to limit the spreading of the two legs during the closing of the switch to a predetermined extent.

* * * * *